US008969266B2

(12) United States Patent
Crawley et al.

(10) Patent No.: US 8,969,266 B2
(45) **Date of Patent: *Mar. 3, 2015**

(54) LUBRICATING COMPOSITION CONTAINING A CARBOXYLIC FUNCTIONALISED POLYMER

(75) Inventors: Seth L. Crawley, Mentor, OH (US); Matthew R. Sivik, Broadview Hts., OH (US); Betsy J. Butke, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 129 days.

This patent is subject to a terminal disclaimer.

(21) Appl. No.: 13/699,088

(22) PCT Filed: Jun. 1, 2011

(86) PCT No.: PCT/US2011/038659

§ 371 (c)(1),
(2), (4) Date: Mar. 1, 2013

(87) PCT Pub. No.: WO2011/153178

PCT Pub. Date: Dec. 8, 2011

(65) Prior Publication Data

US 2013/0203638 A1 Aug. 8, 2013

Related U.S. Application Data

(60) Provisional application No. 61/350,618, filed on Jun. 2, 2010.

(51) Int. Cl.

| | |
|---|---|
| ***C10M 169/04*** | (2006.01) |
| ***C07C 211/58*** | (2006.01) |
| ***C10M 133/12*** | (2006.01) |
| ***C10M 133/14*** | (2006.01) |
| ***C10M 159/16*** | (2006.01) |
| ***C10M 163/00*** | (2006.01) |

(52) U.S. Cl.

CPC ..... *C10M 133/12* (2013.01); *C10M 159/16* (2013.01); *C10M 163/00* (2013.01); *C10M 2203/1025* (2013.01); *C10M 2205/02* (2013.01); *C10M 2205/022* (2013.01); *C10M 2205/024* (2013.01); *C10M 2205/04* (2013.01); *C10M 2207/106* (2013.01); *C10M 2207/1285* (2013.01); *C10M 2209/084* (2013.01); *C10M 2209/103* (2013.01); *C10M 2215/064* (2013.01); *C10M 2215/065* (2013.01); *C10M 2215/223* (2013.01); *C10M 2215/28* (2013.01); *C10M 2217/043* (2013.01); *C10M 2217/0456* (2013.01); *C10M 2217/06* (2013.01); *C10M 2219/0445* (2013.01); *C10M 2219/08* (2013.01); *C10M 2223/043* (2013.01); *C10N 2220/021* (2013.01); *C10N 2230/10* (2013.01); *C10N 2240/04* (2013.01); *C10N 2240/042* (2013.01); *C10N 2240/08* (2013.01); *C10N 2240/10* (2013.01); *C10N 2240/12* (2013.01); *C10N 2240/121* (2013.01); *C10N 2240/14* (2013.01); *C10N 2240/20* (2013.01); *C10N 2250/10* (2013.01)

USPC ..... 508/306; 508/513; 508/556; 508/563

(58) Field of Classification Search

CPC ..... C10M 2215/064; C10M 2217/043; C10M 2217/022

USPC ..... 508/306, 513, 556, 563

See application file for complete search history.

(56) References Cited

U.S. PATENT DOCUMENTS

| | | | | |
|---|---|---|---|---|
| 4,125,479 | A | 11/1978 | Chesluk | |
| 4,668,412 | A * | 5/1987 | Hart et al. | 508/229 |
| 4,880,551 | A | 11/1989 | Doe | |
| 5,856,280 | A | 1/1999 | Kim et al. | |
| 6,191,080 | B1 | 2/2001 | Nakanishi et al. | |
| 6,586,376 | B1 | 7/2003 | Nakanishi et al. | |
| 2010/0016192 | A1 * | 1/2010 | Gieselman | 508/287 |
| 2011/0306528 | A1 * | 12/2011 | Gieselman et al. | 508/261 |

FOREIGN PATENT DOCUMENTS

| | | |
|---|---|---|
| CA | 2196852 | 8/1997 |
| EP | 0537338 | 4/1993 |
| EP | 0735128 | 10/1996 |
| EP | 1574559 | 9/2005 |
| WO | 2008/016967 | 2/2008 |
| WO | 2008/027883 | 3/2008 |
| WO | 2010/099136 | 9/2010 |

OTHER PUBLICATIONS

Corresponding International Publication No. WO 2011/153178 A2 published Dec. 8, 2011.

Search Report from corresponding International Application No. PCT/US2011/038659 dated Dec. 27, 2011.

Written Opinion from corresponding International Application No. PCT/US2011/038659 dated Dec. 27, 2011.

* cited by examiner

*Primary Examiner* — Vishal Vasisth

(74) *Attorney, Agent, or Firm* — Teresan W. Gilbert, Esq.; David M. Shold, Esq.

(57) ABSTRACT

The invention provides a lubricating composition comprising an oil of lubricating viscosity and an amine-functionalized additive, wherein the amine-functionalized additive is derived from an amine having at least 3 aromatic groups, at least one —NH2 functional group, and at least 2 secondary or tertiary amino groups. The invention further provides for the additive to have improved thermal and oxidative stability modifying properties. The lubricating composition may include circulating oils, turbine oils, hydraulic fluids, transformer oils and greases as well as others that require good oxidation stability and good rust inhibition properties.

12 Claims, No Drawings

LUBRICATING COMPOSITION CONTAINING A CARBOXYLIC FUNCTIONALISED POLYMER

This application is a 371 of PCT/US11/38659, filed Jun. 1, 2011 which claims benefit of 61/350,618, filed Jun. 2, 2010.

FIELD OF INVENTION

The invention provides a lubricating composition comprising an oil of lubricating viscosity and an amine-functionalised additive, wherein the amine-functionalised additive is derived from an amine having at least 3 aromatic groups, at least one —$NH_2$ functional group, and at least 2 secondary or tertiary amino groups. The invention further provides for the additive to have improved thermal and oxidative stability modifying properties. The lubricating composition may include circulating oils, turbine oils, hydraulic fluids, transformer oils and greases as well as others that require good oxidation stability and good rust inhibition properties.

BACKGROUND OF THE INVENTION

In recent years, as the performance and the efficiency of machinery equipments and power equipments have become higher, conditions in the working circumstance of lubricating oils and grease have become severer and high quality is required for lubricating oils capable of withstanding such conditions. For example, since jet engines, or gas turbines.

Gas turbine oils are top-quality rust- and oxidation-inhibited oils. In gas turbines, the lubricating oil must withstand contact with very hot surfaces, often with intermittent operation and periods of nonuse. Therefore, to be effective, the oils must have, in addition to good corrosion protection and demulsibility, outstanding resistance to oxidation, which includes a minimum tendency to form deposits in critical areas of the system.

To achieve these desired properties, it is necessary to formulate these oils and greases using a carefully balanced additive package. The nature of these fluids makes them very susceptible to contamination, particularly from other lubricants and additives. A relatively small degree of contamination can markedly affect the properties and expected service life of these lubricants. Further, to maintain effective operating conditions and to avoid damaging the equipment in which they are used, turbine oils should be kept meticulously clean and free of contaminants. Contamination is minimized by filtration of the turbine oils. To ensure that the turbine oils are substantially free of contaminants very fine filters are used.

Due to the requirements of turbine oils, only a few classes of additives, relative to other types of lubricating compositions, are combined with the base oils. Generally, finished turbine oil will contain only the base oil, antioxidants, rust inhibitors, demulsifiers, corrosion inhibitors and diluents, if necessary.

EP 0 735 128 A2 discloses extended life rust and oxidation oils comprising a dithiocarbamate and an alkylphenyl-α-naphthylamine. This reference does not teach the use of Group II or higher (i.e., Group III or Group IV) base oils, or the advantages obtained thereby, as required by the present invention.

U.S. Pat. No. 4,125,479 discloses an oxidation inhibited lubricating oil with a combination of additives comprising methylenebis(di-n-butyldithiocarbamate) and 4-methyl-2,6-ditertiary butyl phenol, said to provide enhanced oxidation inhibition.

U.S. Pat. No. 4,880,551 discloses an antioxidant composition consisting of a 1-(di(4-octylphenyl)aminomethyl)tolutriazole and at least one antioxidant selected from the group consisting essentially of methylenebis(di-n-butyldithiocarbamate); 2,6-di-t-butyl-4-sec-butylphenol; 2,6-di-t-butyl-4-methylphenol and butylated phenol mixture. International EP 0537338 A1, discloses thermally stable lubricant and functional fluid compositions containing hydrocarbyl phosphite in combination with at least one basic alkali or alkaline earth metal salt of an acidic organic compound and a metal deactivator, the composition may additionally contain a dithiocarbamate compound for an antiwear agent. These references do not teach or suggest the combination of components claimed herein.

U.S. Pat. No. 5,856,280 discloses gas turbine lubricating oil comprising a major proportion of synthetic polyol ester based base stock including diesters and polyol esters, preferably polyol ester based base stock and a minor proportion of an antioxidant/deposit control additive, specifically a sulphur-containing carboxylic acid (SCCA) derivatives.

U.S. Pat. No. 6,191,080 discloses that addition of a polyphenyl thioether to a lubricating base oil is extremely useful for providing heat resistance and oxidation resistance under a high temperature condition.

U.S. Pat. No. 6,586,376 discloses heat resistant and oxidation resistant lubricating oil composition comprising a polyphenyl thioether as an antioxidant in lubricating oils where high heat resistance and oxidation resistance are required for lubricating oils used in jet engines, gas turbines and automobile engines such as turbo engines.

Canadian Patent CA 2196852 discloses a synthetic lubricant composition with improved oxidation resistance. The lubricating composition contains an additive formed by combining one or more polyalkylene glycols, singly or in combination, with an effective amount of one or more alkylated aromatic compounds such as alkylated naphthalene.

International publication WO 2008027883 A2 discloses a lubricating composition containing a dispersant, a corrosion inhibitor, and an antioxidant. The invention further provides a method for lubricating a mechanical device with the lubricating composition.

SUMMARY OF THE INVENTION

The inventors of the present invention have discovered that providing a lubricating composition comprising a dispersant capable of providing high heat resistance and oxidation resistance could be desirable for lubricants used in high speed and high temperature environments.

The objectives of the present invention include to provide a lubricating composition with at least one of (i) oxidative stability, (ii) thermal stability, (iii) cleanliness, and (iv) to maintain effective operating conditions of mechanical devices in which the lubricating composition is used.

In one embodiment the invention provides a lubricating composition comprising an oil of lubricating viscosity and an amine-functionalised additive, wherein the amine-functionalised additive is derived from an amine having at least 3 aromatic groups (or at least 4 aromatic groups), at least one —$NH_2$ functional group, and at least 2 secondary or tertiary amino groups.

In one embodiment the invention provides a lubricating composition comprising an oil of lubricating viscosity and a product obtained/obtainable by reacting a carboxylic functionalised polymer with an amine having at least 3 aromatic groups (or at least 4 aromatic groups), at least one —$NH_2$ functional group, and at least 2 secondary or tertiary amino groups.

In one embodiment the invention provides a lubricating composition comprising an oil of lubricating viscosity and an amine functionalised additive is derived from an amine having at least 3 aromatic groups (or at least 4 aromatic groups), at least one —$NH_2$ functional group, and at, least 2 secondary or tertiary amino groups where the —$NH_2$ group is condensed with a hydrocarbyl-substituted phenol, (typically an alkylphenol) and an aldehyde in a Mannish reaction to make a covalent attachment of the amine to the hydrocarbyl-substituted phenol.

In one embodiment the invention provides a lubricating composition comprising the amine-functionalised additive disclosed herein and an alkylated diarylamine (such as an alkylated diphenylamine, or an alkylated phenylnapthylamine). The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl, diphenylamine, or dinonyl diphenylamine. The alkylated diarylamine may include octyl, di-octyl, nonyl, decyl or di-decyl phenylnapthylamines.

The lubricating composition may contain 0 wt % to 5 wt %, or 0.01 wt % to 5.0 wt %, or 0.1 wt % to 2 wt % or 0.1 wt % to 1 wt %, or 0.1 wt to 0.5 wt % of the amine-functionalised additive, and 0.05 wt % to 5 wt %, or 0.1 wt % to 2 wt % or 0.1 wt % to 1 wt % or 0.1 wt % to 0.5 wt % of alkylated diarylamine.

In one embodiment the invention provides a lubricating composition comprising the amine-functionalised additive disclosed herein and a substituted hydrocarbyl sulphide.

The lubricating composition may contain 0 wt % to 5 wt %, 0.01 wt % to 5.0 wt %, or 0.1 wt % to 2 wt % or 0.1 wt % to 1 wt % or 0.1 wt % to 0.5 wt % of the amine-functionalised additive, and 0.05 wt % to 7 wt %, or 0.1 wt % to 5 wt %, or 0.5 wt % to 5 wt %, or 0.5 wt % to 2 wt % of substituted hydrocarbyl sulphide.

In one embodiment the invention provides a lubricating composition comprising the amine-functionalised additive disclosed herein, alkylated diarylamine, and a substituted hydrocarbyl sulphide.

In one embodiment the invention provides a lubricating composition comprising the amine-functionalised additive disclosed herein and phosphorus antiwear agent that may include a phosphorus amine salt.

The lubricating composition may contain 0 wt % to 5 wt %, 0.01 wt % to 5.0 wt %, or 0.1 wt % to 2 wt % or 0.1 wt % to 1 wt % or 0.1 wt % to 0.5 wt % of the amine-functionalised additive and contain 0 wt % to 5 wt %, 0.01 wt % to 5 wt %, or 0.05 wt % to 3 wt %, or 0.1 wt % to 3 wt %, or 0.1 wt % to 2 wt %, or 0.1 wt % to 1 wt % of the phosphorus antiwear agent that may include a phosphorus amine salt.

In one embodiment the invention provides a method of lubricating a mechanical device comprising, supplying to the mechanical device a lubricating composition comprising an oil of lubricating viscosity and an amine-functionalised additive, wherein the amine-functionalised additive is derived from an amine having at least 3 aromatic groups (or at least 4 aromatic groups), at least one —$NH_2$ functional group, and at least 2 secondary or tertiary amino groups.

The mechanical device may include at least one of a hydraulic system, an axle, a gear, a gearbox or a transmission.

In one embodiment the invention provides for the use of the product obtained/obtainable by reacting a carboxylic functionalised polymer with an amine having at least 3 aromatic groups (or at least 4 aromatic groups), at least one —$NH_2$ functional group, and at least 2 secondary or tertiary amino groups as an antioxidant or to improve thermal stability of a lubricating composition.

In one embodiment the invention provides for the use of the product obtained/obtainable by reacting a carboxylic functionalised polymer with an amine having at least 3 aromatic groups (or at least 4 aromatic groups), at least one functional group, and at least 2 secondary or tertiary amino groups as an antioxidant or to improve thermal stability of a lubricant selected from the group consisting of a turbine oil, an industrial gear oil, a hydraulic fluid, or a circulating oil.

In one embodiment the invention provides for the use of the product obtained/obtainable by reacting a carboxylic functionalised polymer with an amine having at least 3 aromatic groups (or at least 4 aromatic groups), at least one —$NH_2$ functional group, and at least 2 secondary or tertiary amino groups as an antioxidant or to improve thermal stability of a grease, wherein the grease comprises a lubricating composition comprising an amine-functionalised additive of the present invention, an oil of lubricating viscosity and a thickener.

DETAILED DESCRIPTION OF THE INVENTION

The present invention provides a lubricating composition and a method for lubricating a mechanical device as disclosed above.

As used herein the term 'substantially free of' means the lubricating composition contains not more than contaminant amounts of water, for example water present at less than 2 wt %, preferably less than 1 wt %, or even 0.5 wt % or less of the lubricating composition.

It should however be noted that during application of the lubricating composition in industrial fluids, hydraulic fluids, turbine oils, circulating oils, or combinations thereof, extraneous water may be incorporated into the system. The extraneous water is not included in the contaminant amounts of water disclosed above.

In one embodiment the lubricating composition is substantially free of, or even free of, water. In one embodiment the lubricating composition is not an oil-in water emulsion.

As used herein the term "an aromatic group" is used in the ordinary sense of the term and is known to be defined by Hückel theory of $4n+2\pi$ electrons per ring system. Accordingly, one aromatic group of the invention may have 6, or 10, or $14\pi$ electrons. Hence a benzene ring as $6\pi$ electrons, a naphthylene ring has $10\pi$ electrons and an acridine group has $14\pi$ electrons.

In one embodiment the product may be obtained/obtainable by reacting a carboxylic functionalised polymer with an amine having at least 4 aromatic groups, at least one —$NH_2$ functional group, and at least 2 secondary or tertiary amino groups. It is generally understood that condensation reactions occur most readily with primary amino groups, so in one embodiment the amine comprises at least one primary amino group and least two secondary or tertiary amino groups that is to say, at least two other amino groups that are non-primary, i.e., any combination of secondary or tertiary amino groups.

The amine having at least 3 aromatic groups, at least one —$NH_2$ functional group, and at least 2 secondary or tertiary amino groups may be represented by Formula (1):

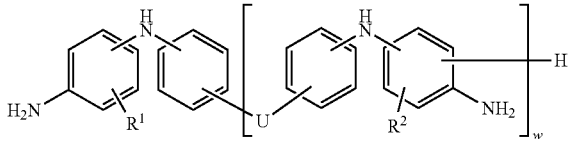

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

The amine having at least 3 aromatic groups, at least one —$NH_2$ functional group, and at least 2 secondary or tertiary amino groups may be represented by Formula (1a):

Formula (1a)

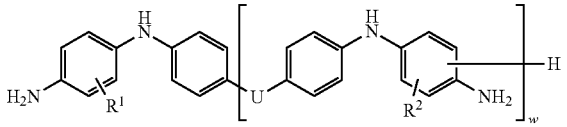

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

Alternatively, the compound of Formula (1 may also be represented by:

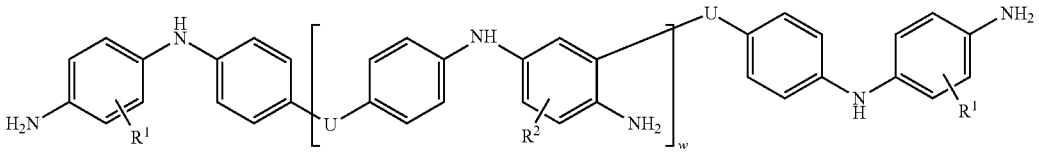

wherein each variable U, $R^1$, and $R^2$ are the same as described above and w is 0 to 9 or 0 to 3 or 0 to 1 (typically 0).

Examples of an amine having at least 3 aromatic groups may be represented by any of the following Formulae (2) and/or (3):

Formula (2)

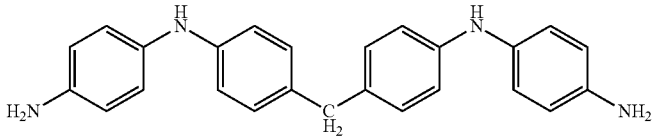

Formula (3)

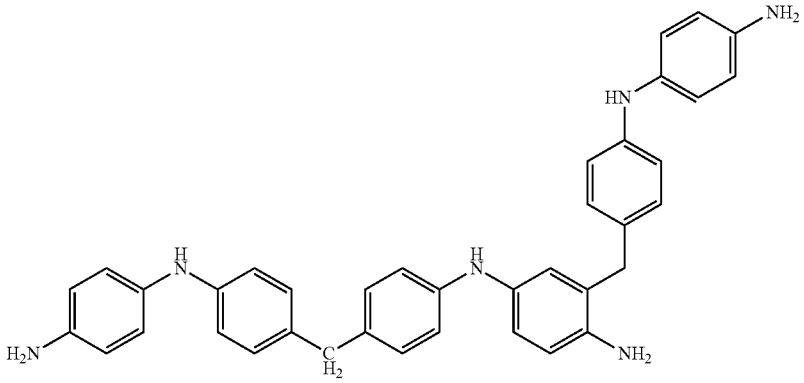

In one embodiment the amine having at least 3 aromatic groups may include mixtures of compounds represented by the formulae disclosed above. A person skilled in the art will appreciate that compounds of Formulae (2) and (3) may also react with the aldehyde described below to form acridine derivatives. Acridine derivatives that may be formed include compounds illustrated represented by Formula (2a) or (3a) below. In addition to these compounds represented these formulae, a person skilled in the art will also appreciate that other acridine structures may be possible where the aldehyde reacts with other benzyl groups bridged with the >NH group. Examples of acridine structures include those represented by Formulae (2a) and (3a):

Formula (2a)

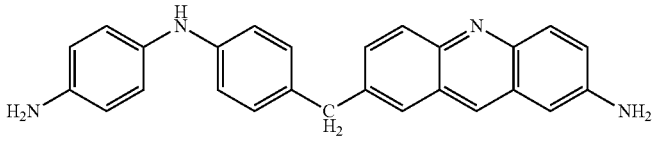

Formula (3a)

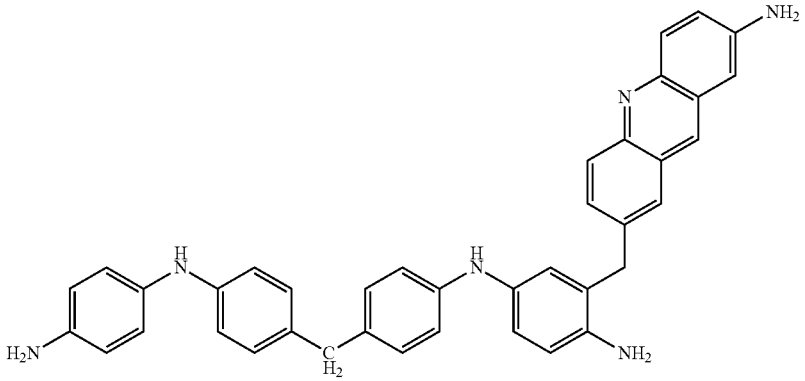

Any or all of the N-bridged aromatic rings are capable of such further condensation and perhaps aromaticisation. One other of many possible structures is shown in Formula (3b),

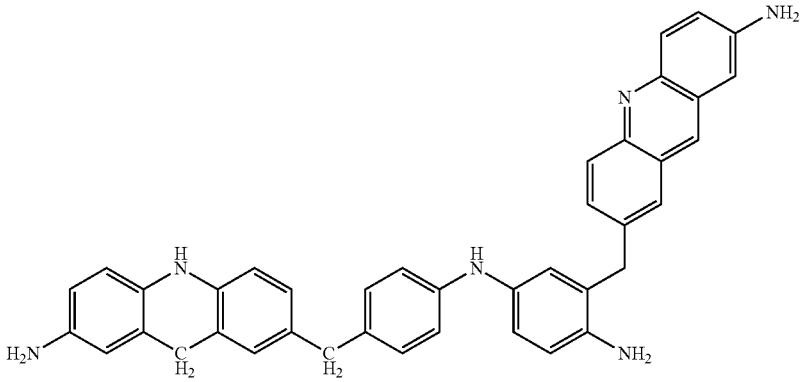

Examples of the amine having at least 3 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine, $N^4$-{4-[4-(4-amino-phenylamino)-benzyl]-phenyl}-2-[4-(4-amino-phenylamino)-cyclohexa-1,5-dienylmethyl]-benzene-1,4-diamine, N-[4-(7-amino-acridin-2-ylmethyl)-phenyl]-benzene-1,4-diamine, or mixtures thereof.

In one embodiment the amine having at least 3 aromatic groups may be bis[p-(p-aminoanilino)phenyl]-methane, 2-(7-amino-acridin-2-ylmethyl)-N-4-{4-[4-(4-amino-phenylamino)-benzyl]-phenyl}-benzene-1,4-diamine or mixtures thereof.

The amine having at least 3 aromatic groups may be prepared by a process comprising reacting an aldehyde with an amine (typically 4-aminodiphenylamine). The resultant amine may be described as an alkylene coupled amine having at least 3 aromatic groups, at least one —$NH_2$ functional group, and at least 2 secondary or tertiary amino groups.

The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde.

The process may be carried out at a reaction temperature in the range of 40° C. to 180° C. or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, or mixtures thereof.

The reaction may be preformed in either air or an inert atmosphere. Examples of suitable inert atmosphere include nitrogen or argon, typically nitrogen.

Alternatively, the amine having at least 3 aromatic groups may also be prepared by the methodology described in Berichte der Deutschen Chemischen Gesellschaft (1910), 43, 728-39.

In some embodiments, particularly when the compositions of the present invention are turbine oils containing Group II oils, the amine-functionalised additive described above is present in the composition from 0.1 to 0.75 wt % or from 0.3 to 0.6 wt %, or from 0.45 to 0.55 wt %, or even about 0.5 wt %. In other embodiments, particularly when the compositions of the present invention are turbine oils containing Group III oils, the amine-functionalised additive described above is present in the composition from 0.1 to 0.5 wt % or from 0.2 to 0.4 wt %, or from 0.2 to 0.3 wt %, or even about 0.25 wt %.

Carboxylic Functionalised Polymer

The additive which is functionalised with an amine may be a carboxylic functionalised polymer. The carboxylic functionalised polymer backbone may be a homopolymer or a copolymer, provided that it contains at least one carboxylic acid functionality or a reactive equivalent of carboxylic acid functionality (e.g., anhydride or ester). The carboxylic functionalised polymer has a carboxylic acid functionality (or a reactive equivalent of carboxylic acid functionality) grafted onto the backbone, within the polymer backbone or as a terminal group on the polymer backbone.

The carboxylic functionalised polymer may be a polyisobutylene-succinic anhydride polymer, a maleic anhydride-styrene copolymer, an ester of a maleic anhydride-styrene copolymer, an alpha olefin-maleic anhydride copolymer, or a maleic anhydride graft copolymer of (i) a styrene-ethylene-alpha olefin polymer, (ii) a hydrogenated alkenyl aryl conjugated diene copolymer (that is, a hydrogenated alkenyl arene conjugated diene copolymer, in particular a hydrogenated copolymer of styrene-butadiene), (iii) a polyolefin (in particular ethylene-propylene copolymer), or (iv) a hydrogenated isoprene polymer (in particular isobutylene-isoprene copolymer or a hydrogenated styrene-isoprene polymer), or mixtures thereof.

The carboxylic functionalised polymer described herein is known in lubricant technology. For example:

(i) esters of maleic anhydride and styrene-containing polymers are known from U.S. Pat. No. 6,544,935;

(ii) grafted styrene-ethylene-alpha olefin polymers are taught in International publication WO 01/30947;

(iii) copolymers derived from isobutylene and isoprene have been used in preparing dispersants and are reported in International publication WO 01/98387;

(iv) grafted styrene-butadiene and styrene-isoprene copolymers are described in a number of references including DE 3,106,959; and U.S. Pat. Nos. 5,512,192, and 5,429,758;

(v) polyisobutylene succinic anhydrides have been described in numerous publications including U.S. Pat. Nos. 4,234,435; 3,172,892; 3,215,707; 3,361,673; and 3,401,118;

(vi) grafted ethylene-propylene copolymers have been described in U.S. Pat. Nos. 4,632,769; 4,517,104; and 4,780,228;

(vii) esters of (alpha-olefin maleic anhydride) copolymers have been described in U.S. Pat. No. 5,670,462;

(viii) copolymers of isobutylene and conjugated dienes (such as isobutylene-isoprene copolymer) have been described in U.S. Pat. Nos. 7,067,594 and 7,067,594 and US Patent Application US 2007/0293409; and (ix) terpolymers of ethylene, propylene and non-conjugated diene (such as dicyclopentadiene or butadiene) and described in U.S. Pat. Nos. 5,798,420 and 5,538,651.

Many of the polymer backbones are also described in "Chemistry and Technology of Lubricants, Second Edition, Edited by R. M. Mortier and S. T. Orszulik Published by Blackie Academic & Professional. In particular pages 144-180 discuss many of the polymer backbones (i)-(iv) and (vi)-(viii), The polymer backbone (other than a polyisobutylene) of the present invention may have a number average molecular weight (by gel permeation chromatography, polystyrene standard), which may be up to 150,000 or higher, e.g., 1,000 or 5,000 to 150,000 or to 120,000 or to 100,000. An example of a suitable number average molecular weight range includes 10,000 to 50,000, or 6,000 to 15,000, or 30,000 to 50,000. In one embodiment, the polymer backbone has a number average molecular weight of greater than 5,000, for instance, greater than 5000 to 150,000. Other combinations of the above-identified molecular weight limitations are also contemplated.

When the polymer backbone of the invention is a polyisobutylene, its number average molecular weight (by gel permeation chromatography, polystyrene standard), may be 350 to 5000, or 550 to 3000 or 750 to 2500. (Thus, a polyisobutylene succinic anhydride may have, that is, be derived from, a polyisobutylene with any of the foregoing molecular weights.) Commercially available polyisobutylene polymers have a number average molecular weight of 550, 750, 950-1000, 1550, 2000, or 2250. Some of the commercially available polyisobutylene polymers may obtain the number average molecular weights shown above by blending one or more polyisobutylene polymers of different weights.

The amine having at least 3 aromatic groups may be reacted with the carboxylic functionalised polymer under known reaction conditions. The reaction conditions are known to a person skilled in the art for forming imides and/or amides of carboxylic functionalised polymers.

The invention product obtained/obtainable by reacting a carboxylic functionalised polymer with an amine having at least 3 aromatic groups, at least one —$NH_2$ functional group, and at least 2 secondary or tertiary amino groups may be represented by the Formulae (4) and/or (5):

Formula (4)

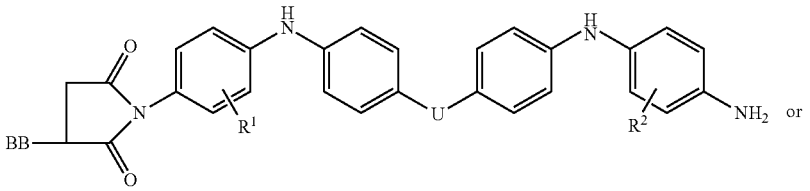

-continued

Formula (5)

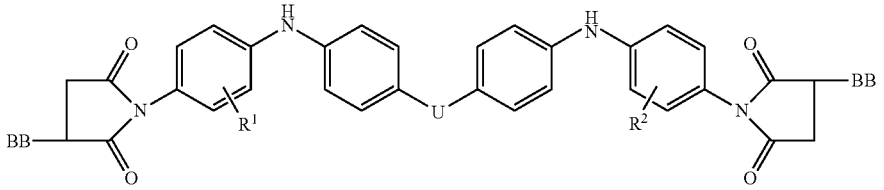

wherein independently each variable, $R^2$ and U are described previously;

BB is a polymer backbone and may be polyisobutylene, or copolymers of (i) hydrogenated alkenyl aryl conjugated diene copolymers (in particular hydrogenated copolymers of styrene-butadiene), (ii) polyolefins (in particular ethylene-alphaolefins such as ethylene-propylene copolymers), or (iii) hydrogenated isoprene polymers (in particular hydrogenated styrene-isoprene polymers). BB may be substituted with one succinimide group as is shown in formulae (4) and (5), or it may be substituted by multiple succinimide groups.

In addition to formulae (4) and (5), additional structures may also be formed including trimers, tetramers, higher-mers or mixtures thereof. The amino groups shown in Formulae (4) and (5) may also be replaced, in whole or in part, by the amine of formula (3), or mixtures thereof.

When BB is polyisobutylene the resultant carboxylic functionalised polymer may typically be polyisobutylene succinic anhydride. Typically w, as defined in Formula (1) may be 1 to 5, or 1 to 3.

When BB is other than polyisobutylene, and has maleic anhydride (or other carboxylic acid functionality) grafted thereon, one or more of the grafted maleic anhydride groups is a succinimide of the amine of the invention. The number of succinimide groups may be 1 to 40, or 2 to 40, or 3 to 20.

The invention product is obtained/obtainable by reacting a carboxylic functionalised polymer derived from maleic anhydride-styrene copolymers, esters of maleic anhydride-styrene copolymers, (alpha-olefin maleic anhydride) copolymers; or mixtures thereof with an amine having at least 3 aromatic groups, at least one —$NH_2$ functional group, and at least 2 secondary or tertiary amino groups. The resultant product may be represented by Formula (6):

groups (or at least 4 aromatic groups), at least one —$NH_2$ functional group, and at, least 2 secondary or tertiary amino groups where the —$NH_2$ group is condensed with a hydrocarbyl-substituted phenol, (typically an alkylphenol) and an aldehyde in a Mannich reaction to make a covalent attachment of the amine to the hydrocarbyl-substituted phenol. Reactions to form Mannich products are known.

The aldehyde used to form the Mannich product may have 1 to 10, or 1 to 4 carbon atoms, and is generally formaldehyde or a reactive equivalent thereof such as formalin or paraformaldehyde.

The hydrocarbyl substituent of the hydrocarbyl-substituted phenol may have 10 to 400, or 30 to 180, or 40 to 110 carbon atoms. This hydrocarbyl substituent may be derived from an olefin or a polyolefin. Useful olefins include alpha-olefins, such as 1-decene, which are commercially available. Polyolefins suitable for preparing Mannich reaction product of the invention are the same as those are described above. The hydrocarbyl-substituted phenol may be prepared by alkylating phenol with an olefin or polyolefin described above, such as, a polyisobutylene or polypropylene, using well-known alkylation methods. In one embodiment the hydrocarbyl-substituted phenol may be prepared by alkylating phenol with polyisobutylene.

Further Reaction with Polyamines

Reaction of the amine functionalised additive (e.g., aromatic amine functionalised polymer) with additional polyamines having two or more reactive sites may be possible and useful as long as the carboxylic acid functionality is low enough or the polyamine charge is high enough to avoid significant crosslinking of the polymer as evidenced by gellation, incompatibility or poor oil solubility.

Examples of suitable polyamines include ethylenediamine, 1,2-diaminopropane, N-methylethylenediamine, Formula (6)

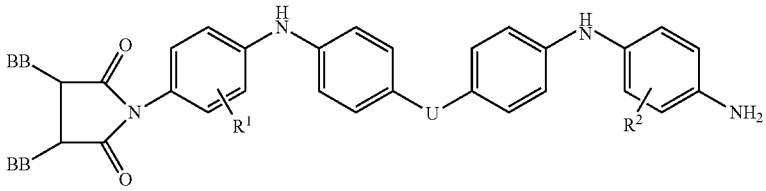

wherein $R^1$, $R^2$ and U are described previously;

BB may be a styrene-containing polymer chain that may contain additional succinimide groups.

Formula (6) may also replace the amine containing group shown in Formula (6) with the amine of Formula (3), or mixtures thereof.

Mannich Reaction

In one embodiment the amine-functionalised additive disclosed herein may be a Mannich reaction product obtained/obtainable by reacting the amine having at least 3 aromatic N-tallow($C_{16}$-$C_{18}$)-1,3-propylene-diamine, N-oleyl-1,3-propylenediamine, polyethylenepolyamines (such as diethylenetriamine, triethylenetetramine, tetraethylenepentamine and "polyamine bottoms" (or "alkylenepolyamine bottoms")). In one embodiment the polyamine includes polyalkylenepolyamines. An additive of Formula (1) derived from one of the polyamines is believed to have dispersant properties. And an additive derived from one of the polyamines of Formula (1) is believed to have dispersant properties.

In general, alkylenepolyamine bottoms may be characterised as having less than two, usually less than 1% (by weight) material boiling below about 200° C. A typical sample of such ethylene polyamine bottoms obtained from the Dow Chemical Company of Freeport, Tex. designated "HPAX™", or from Huntsman as "E-100™". These alkylenepolyamine bottoms may be prepared using an ethylene dichloride process.

Alternatively, capping amines (i.e., monoreactive, monocondensing, non-crosslinking) may be used alone or a combination of capping amines with non capping polyamines.

Capping Polymer with an Amine

Optionally the amine-functionalised additive may further react with a capping amine, or mixtures thereof. The capping amine may be used to modify the total acid number (herein after referred to as TAN) (typically a reduction in TAN) of the amine-functionalised additive of the invention. The capping amine may if necessary, cap unreacted carboxylic groups in an amount to minimise any detrimental impact on other additives e.g., detergent. The detrimental impact may include an interaction between the amine-containing additive and the detergent, resulting in formation of a gel. In one embodiment the amine-functionalised additive is further reacted with a capping amine. In one embodiment the amine-functionalised additive is not further reacted with a capping amine.

The capping amine may be a monoamine or a polyamine. The capping amine may be an aromatic amine or non-aromatic.

The capping amine may be an amine having two linked aromatic moieties. By the term "aromatic moiety is meant to include both mononuclear and polynuclear groups. The capping amine will typically have an N—H group capable of condensing with the one ore more carboxylic groups on the polymer that have not reacted with the amine of the present invention.

The polynuclear groups may be of the fused type wherein an aromatic nucleus is fused at two points to another nucleus such as found in naphthyl or anthranyl groups. The polynuclear group may also be of the linked type wherein at least two nuclei (either mononuclear or polynuclear) are linked through bridging linkages to each other. These bridging linkages may be chosen from, among others known to those skilled in the art, alkylene linkages, ether linkages, ester linkages, keto linkages, sulphide linkages, polysulphide linkages of 2 to 6 sulphur atoms, sulphone linkages, sulphonamide linkages, amide linkages, azo linkages, and direct carbon-carbon linkages between the groups without any intervening atoms. Other aromatic groups include those with heteroatoms, such as pyridine, pyrazine, pyrimidine, and thiophene. Examples of the aromatic groups that are useful herein include the aromatic groups derived from benzene, naphthalene, and anthracene, preferably benzene. Each of these various aromatic groups may also be substituted by various substituents, including hydrocarbyl substituents.

The capping amine may, in general, contain one or more reactive (condensable) amino groups. A single reactive amino group is sometimes preferred. Multiple amino groups, as in the case of the above described N,N-dimethylphenylenediamines, may be useful as well, especially if they are reacted under relatively mild conditions so as to avoid excessive crosslinking or gellation of the additive.

In one embodiment the capping amine is derived from dye intermediates containing multiple aromatic rings linked by, for example, amide structures. Examples include materials of the general Formula (7):

Formula (7)

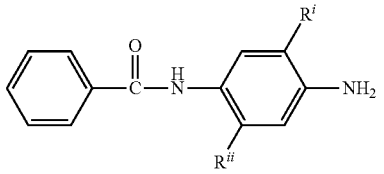

and isomeric variations thereof, where $R^i$ and $R^{ii}$ are independently alkyl or alkoxy groups such as methyl, methoxy, or ethoxy. In one instance, $R^i$ and $R^{ii}$ are both —$OCH_3$ and the material is known as Fast Blue RR [CAS#6268-05-9]. The orientation of the linking amido group may be reversed, to —NR—C(O)—.

In another instance, $R^{ii}$ is —$OCH_3$ and $R^i$ is —$CH_3$, and the material is known as Fast Violet B [99-21-8]. When both $R^i$ and $R^{ii}$ are ethoxy, the material is Fast Blue BB [120-00-3]. U.S. Pat. No. 5,744,429 discloses other capping amine compounds, particularly aminoalkylphenothiazines. N-aromatic substituted acid amide compounds, such as those disclosed in U.S. Patent Application 2003/0030033 A1, may also be used for the purposes of this invention. Suitable capping amines include those in which the amine nitrogen is a substituent on an aromatic carbocyclic compound, that is, the nitrogen is not $sp^2$ hybridised within an aromatic ring.

In one embodiment the capping amine may be an amine having two aromatic moieties linked by an —O— group. An example of such an amine is phenoxyphenylamine, also known as phenoxyaniline or aminophenyl phenyl ether, which may be represented by Formula (8):

Formula (8)

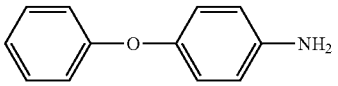

and its various positional isomers (4-phenoxy, 3-phenoxy, and 2-phenoxy-aniline). Either or both of the aromatic groups may bear substituents, including hydrocarbyl, tertiary amino, halo, sulphoxy, hydroxy, nitro, carboxy, and alkoxy substituents. The amine nitrogen may be a primary amine nitrogen, as shown, or it may be secondary, that is, bearing a further substituent such as hydrocarbyl, preferably short chain alkyl such as methyl. In one embodiment, the capping amine is the unsubstituted material shown above.

The capping amine may be an amine having two aromatic moieties linked by an —N═N— group, an azo group. Such a material may be represented by Formula (9):

Formula (9)

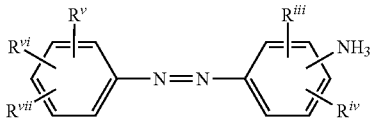

wherein each R group are hydrogen or substituents as described above for the phenoxyphenylamine. Thus, each or $R^{iii}$ and $R^{iv}$ may be independently be H, —$NH_2$, hydrocarbyl or alkyl such as —$CH_3$, halo such as —Cl, sulphoxy such as —$SO_3H$, or —$SO_3Na$; and each of $R^v$, $R^{vi}$, and $R^{vi}$ is independently H, —OH, —$NO_2$, —$SO_3H$, carboxy such as —$CO_2Na$, or alkoxy such as —$OC_4H_9$. These materials are described in greater detail in U.S. Pat. No. 5,409,623, see column 4.

In one embodiment the azo-linked capping amine may be represented by Formula (10):

Formula (10)

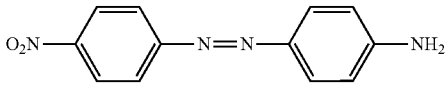

that is, 4-(4-nitrophenylazo)aniline, as well as positional isomers thereof. The material shown is commercially available as a dye known as Disperse Orange 3.

In one embodiment capping amine may be an amine having two aromatic moieties linked by a —C(O)O— group. Each group may be substituted as described above for the oxygen-linked and the azo-linked amines. In one embodiment this amine may be represented by Formula (11):

Formula (11)

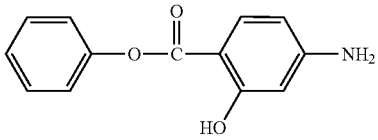

as well as positional isomers thereof. The material shown is phenyl-4-amino salicylate or 4-amino-2-hydroxy benzoic acid phenyl ester, which is commercially available.

In one embodiment the capping amine may be a diamine represented by the N,N-dialkylphcnylenediamine Formula (12):

Formula (12)

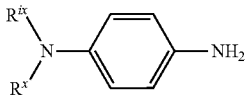

wherein $R^{ix}$ and $R^{x}$ may independently be hydrogen or a hydrocarbyl group (typically containing 1 to 6 carbon atoms).

An example of a particularly useful compound defines both $R^{ix}$ and $R^{x}$ as methyl (N,N-dimethyl-1,4-phenylenediamine).

In one embodiment the capping amine may be an amine having two aromatic moieties linked by an —$SO_2$— group. Each of the aromatic moieties may be substituted as described above for the oxygen-linked and the azo-linked amines. In one embodiment the linkage, in addition to —$SO_2$—, further contains an —NR— or specifically an —NH— group, so that the entire linkage is —$SO_2$NR— or —$SO_2$NH—. In one embodiment, this capping amine may be represented by Formula (13):

Formula (13)

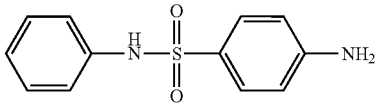

The structure as shown is that of 4-amino-N-phenyl-benzenesulphonamide. A commercially available variation thereof is sulphamethazine, or N'-(4,6-dimethyl-2-pyrimidinyl)sulphanilamide (CAS Number 57-68-1) which is believed to be represented by Formula (14):

Formula (14)

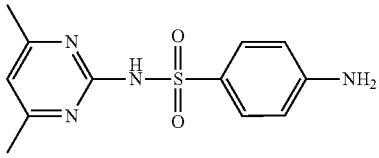

Sulphamethazine is commercially available.

The capping amine may be a nitro-substituted aniline, which can, likewise, bear the substituents as described above for the oxygen-linked and the azo-linked amines. Included are the ortho-, meta-, and para-substituted isomers of nitroaniline. In one embodiment the amine is 3-nitro-aniline, Examples of other suitable capping amines include amino-substituted aromatic compounds and amines in which the amine nitrogen is a part of an aromatic ring, such as 3-aminoquinoline, 5-aminoquinoline, and 8-amino-quinoline. Also included are capping amines such as 2-aminobenzimidazole, which contains one secondary amino group attached directly to the aromatic ring and a primary amino group attached to the imidazole ring. Other amines include N-(4-anilinophenyl)-3-aminobutanamide or 3-amino propyl imidazole, or 2,5-dimethoxybenzylamine.

The capping amine may also be an aminoquinoline. Commercially available materials include 3-aminoquinoline, 5-aminoquinoline, 6-amino-quinoline, and 8-aminoquinoline and homologues such as 4-aminoquinaldine.

The capping amine may also be an aminobenzimidazole such as 2-aminobenzimidazole.

The capping amine may also be a ring-substituted benzylamine, with various substituents as described above. One such benzyl amine is 2,5-dimethyoxybenzylamine.

Examples of particularly useful capping amines include aniline, N-alkylanilines such as N-methylaniline and N-butylaniline, di-(para-methylphenyl)amine, 4-aminodiphenylamine, N,N-dimethylphenylenediamine, naphthylamine, 4-(4-nitrophenylazo)aniline (disperse orange 3), sulpha-methazine, 4-phenoxyaniline, 3-nitroaniline, 4-aminoacetanilide (N-(4-amino-phenyl)acetamide)), 4-amino-2-hydroxy-benzoic acid phenyl ester (phenyl amino salicylate), N-(4-aminophenyl)-benzamide, various benzylamines such as 2,5-dimethoxybenzylamine, 4-phenylazoaniline, and substituted versions of these. Other examples include para-ethoxyaniline, para-dodecylaniline, cyclohexyl-substituted naphthylamine, and thienyl-substituted aniline.

Additional capping amines and related compounds are disclosed in U.S. Pat. Nos. 6,107,257 and 6,107,258; some of these include aminocarbazoles, benzoimidazoles, aminoindoles, aminopyrroles, amino-indazolinones, mercapto-triazoles, aminophenothiazines, aminopyridines, aminopyrazines, amino-pyrimidines, pyridines, pyrazines, pyrimidines, aminothiadiazoles, aminothio-thiadiazoles, and aminobenzotriaozles. Other suitable amines include 3-amino-N-(4-anilinophenyl)-N-isopropyl butanamide, and N-(4-anilinophenyl)-3-{(3-aminopropyl)-cocoalkyl) amino}butanamide.

In one embodiment the capping amine may be useful as an antioxidant. Of particular importance in that regard are alkylated diphenyl-amines such as nonyldiphenylamine and dinonyldiphenylamine or even diphenyl amine. To the extent that these materials will condense with the carboxylic functionality of the polymer chain, they are also suitable for use within the present invention. However, it is believed that the two aromatic groups attached to the amine nitrogen may lead to steric hindrance and reduced reactivity. Thus, suitable amines include those having a primary nitrogen atom (—$NH_2$) or a secondary nitrogen atom in which one of the hydrocarbyl substituents is a relatively short chain alkyl group, e.g., methyl. Among such capping amines are 4-phenylazoaniline, 4-aminodiphenylamine, 2-aminobenzimidazole, and N,N-dimethylphenylenediamine. Some of these and other capping amines may also impart antioxidant performance to the polymers, in addition to dispersancy and other properties.

The above-described capping amines may be used alone or in combination with each other. They can also be used in combination with additional, aromatic or non-aromatic, e.g., aliphatic, amines, which, in one embodiment, have 1 to 8 carbon atoms. Other capping amines can include such amines as aminodiphenylamine or even diphenyl amine. These additional amines may be included for a variety of reasons. Sometimes it may be desirable to incorporate an aliphatic amine in order to assure complete reaction of the acid functionality of the polymer, in the event that some residual acid functionality may tend to react incompletely with the relatively more bulky capping amine. Alternatively, the aliphatic amine may replace a portion of a more costly aromatic amine, while maintaining the majority of the performance of the capped additive. Aliphatic monoamines include methylamine, ethylamine, propylamine and various higher amines. Diamines or polyamines may be used for this function i.e., capping, provided that, in general, they have only a single reactive amino group, that is, a primary or secondary group; and typically a primary group. Suitable examples of diamines include dimethylaminopropylamine, diethylaminopropylamine, dibutylaminopropylamine, dimethylaminoethylamine, diethylaminoethylamine, dibutylaminoethylamine, 1-(2-aminoethyl) piperidine, 1-(2-aminoethyl)pyrrolidone, aminoethylmorpholine, and aminopropylmorpholine. The amount of such an amine is typically a minor amount compared with the amount of the capping amine, that is, less than 50% of the total amine present on a weight or molar basis, although higher amounts may be used, such as 70 to 100%. Exemplary amounts include 10 to 70 weight percent, or 15 to 50 weight percent, or 20 to 40 weight percent. Use of certain combinations of 4-phenoxyaniline with dimethylaminopropylamine within these ranges, for instance, provides particularly good performance in terms of soot suspension. In certain embodiments, the polymers may be functionalised with three or more different amines, for instance, with 3-nitroaniline, 4-(4-nitrophenylazo)aniline, and dimethylaminopropylamine.

In one embodiment the capping amine may be selected from the group consisting of aniline, 4-aminodiphenylamine, benzylamine, phenethylamine, 3,4-dimethoxyphenethylamine, 1,4-dimethylphenylenediamine, and mixtures thereof.

In one embodiment the capping amine may be selected from the group consisting of aniline, 4-aminodiphenylamine, 1,4-dimethylphenylenediamine, and mixtures thereof.

The capping amine may be reacted with the amine having at least 3 aromatic groups by a process comprising: reacting (i) a product obtained/obtainable by reacting a carboxylic functionalised polymer with an amine having at least 3 aromatic groups, at least one —$NH_2$ functional group, and at least 2 secondary or tertiary amino groups, with (ii) a capping amine as disclosed herein above.

The process may be carried out at a reaction temperature in the range of 40° C. to 180° C., or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, or mixtures thereof.

The reaction may be preformed in either air or an inert atmosphere. Examples of suitable inert atmosphere include nitrogen or argon, typically nitrogen.

Substituted Hydrocarbyl Sulphide

In one embodiment the lubricating composition further includes a substituted hydrocarbyl sulphide, or mixtures thereof.

The substituted hydrocarbyl sulphide, may be a hydroxy-substituted hydrocarbyl sulphide, or a thiol-substituted hydrocarbyl sulphide. In one embodiment substituted hydrocarbyl sulphide, may be a hydroxy-substituted hydrocarbyl sulphide.

The hydrocarbyl group may be linear, branched, aliphatic, alicyclic, or mixtures thereof. The hydrocarbyl group may contain 1 to 20, or 4 to 16, or 8 to 16 carbon atoms.

Examples of a substituted hydrocarbyl sulphide, may include 1-(tert-dodecylthio)-2-propanol, 1-(tert-decylthio)-2-propanol, or 1-(tert-butadecylthio)-2-propanol. In one embodiment substituted hydrocarbyl sulphide, may include 1-(tert-dodecylthio)-2-propanol.

Phosphorus Antiwear Agent

In one embodiment the lubricating composition further includes a phosphorus antiwear agent, or mixtures thereof.

The phosphorus antiwear agent may include a phosphorus amine salt, or mixtures thereof. The phosphorus amine salt includes an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C. Armeen O, Armeen OL, Armeen T, Armeen HT. Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethyibutylamine and ethylamylamine. The secondary amines may be cyclic amines such as piperidine, piperazine and morpholine.

The amine may also be a tertiary-aliphatic primary amine. The aliphatic group in this case may be an alkyl group containing 2 to 30, or 6 to 26, or 8 to 24 carbon atoms. Tertiary alkyl amines include monoamines such as tert-butylamine tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanyl amine, and tert-octacosanyl amine.

In one embodiment the phosphorus acid amine salt includes an amine with C11 to C14 tertiary alkyl primary groups or mixtures thereof. In one embodiment the phosphorus acid amine salt includes an amine with C14 to C18 tertiary alkyl primary amines or mixtures thereof. In one embodiment the phosphorus acid amine salt includes an amine with C18 to C22 tertiary alkyl primary amines or mixtures thereof. Mixtures of amines may also be used in the invention. In one embodiment a useful mixture of amines is "Primene® 81R" and "Primene® JMT/" Primene® 81R and Primene® JMT (both produced and sold by Rohm & Haas) are mixtures of C11 to C14 tertiary alkyl primary amines and C18 to C22 tertiary alkyl primary amines respectively.

In one embodiment oil soluble amine salts of phosphorus compounds include a sulphur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in International Application PCT/US08/051126 (or equivalent to U.S. application Ser. No. 11/627,405).

In one embodiment the hydrocarbyl amine salt of an alkylphosphoric acid ester is the reaction product of a C14 to C18 alkylated phosphoric acid with Primene 81R™ (produced and sold by Rohm & Haas) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C.) for 2.5 hours, mixed with a diatomaceous earth and filtered at 70° C. The filtrate contains 11.8% by weight phosphorus, 15.2% by weight sulphur, and an acid number of 87 (bromophenol blue).

In one embodiment the antiwear additives may include a zinc di alkyldithiophosphate, particularly when the lubricating composition involved is a gear oil lubricant. In other embodiments the compositions of the present invention are substantially free of, or even completely free of zinc dialkyldithiophosphates.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil. In one embodiment the oil of lubricating viscosity may be an API Group II oil. In one embodiment the oil of lubricating viscosity may be an API Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

A lubricating composition may be prepared by adding the product of the process described herein to an oil of lubricating viscosity, optionally in the presence of other performance additives (as described herein below).

Additional components may be used in preparing a lubricant according to the present invention, for instance, those additives typically employed in a turbine oil, a grease composition, a gear oil, a hydraulic fluid, an automatic transmission fluid, and other lubricants as well.

Other Performance Additives

The other performance additives comprise at least one of metal deactivators, viscosity modifiers, detergents, friction modifiers, antiwear agents, corrosion inhibitors, dispersants (other than the amine functionalised additive of present invention as described above), dispersant viscosity modifiers (other than the amine functionalised additive of present invention as described above), extreme pressure agents, antioxidants (other than the amine functionalised additive of present invention as described above), foam inhibitors, demulsifiers, pour point depressants, seal swelling agents, a carboxylic acid or anhydride thereof and mixtures thereof. Typically, fully-formulated lubricating oil will contain one or more of these performance additives.

The compositions of the present invention optionally include a corrosion inhibitor. When present, the corrosion inhibitor is not overly limited. In some embodiments the corrosion inhibitor includes one or more fatty acids, esterified derivatives thereof, amine salts of dinonylnaphthalenesulphonic acid, and combinations thereof. Specific examples of suitable corrosion inhibitors include long chain fatty acid such as oleic acid, linoleic acid, and the like. The esterified and/or polyol versions of these acids may also be used, including glycerol monooleate and similar derivates of such acids. Amine salts of dinonylnaphthalenesulphonic acid may also be used in including the corrosion inhibitors commercially available under the trade name NA-SUL™ from King Industries. Specific examples include the basic metal salts of dinonylnaphthalenesulphonic acid where the acids are salted with an amine, including NA-SUL™ EDS (which is salted with ethylenediamine).

Suitable corrosion inhibitors also include amine salts of carboxylic acids, such as octylamine octanoate, condensation products of dodecenyl succinic acid or anhydride or a fatty acid, such as oleic acid with a polyamine, e.g. a polyalkylene polyamine such as triethylenetetramine, and half esters of alkenyl succinic acids in which the alkenyl radical contains about 8 to about 24 carbon atoms with alcohols such as polyglycols. The corrosion inhibitors can be used alone or in combination with other corrosion inhibitors.

In some embodiments the compositions of the present invention include an ashless antiwear additive. Suitable antiwear additives include hydrocarbyl phosphoric acids or acid esters, hydrocarbyl thiophosphoric acids or acid esters, hydrocarbyl dithiophosphoric acids or acid esters, amine salts of one or more of these acids and acid esters, or combinations thereof.

Suitable detergents include neutral and overbased detergents. Suitable detergent substrates include, phenates, sulphur containing phenates, sulphonates, salixarates, salicylates, carboxylic acids, phosphorus acids, mono- and/or di-thiophosphorie acids, alkyl phenols, sulphur coupled alkyl phenol compounds, or saligenins. The detergent may be natural or synthetic. In one embodiment the detergent is synthetic. In one embodiment the detergent comprises a sulphonate detergent. The sulphonate detergent may also have corrosion inhibitor properties. Examples of suitable detergents include at least one of calcium dinonyl naphthalene suiphonate, calcium didecyl naphthalene sulphonate, didodecyl naphthalene sulphonate, calcium dipentadecyl naphthalene sulphonate, or mixtures thereof. In one embodiment the detergent comprises neutral or slightly overbased calcium dinonyl naphthalene sulphonate, or mixtures thereof.

Suitable antioxidants include alkylated diphenylamines, hindered phenols, molybdenum dithiocarbamates, and mixtures thereof. Suitable antioxidants also include alkylated alpha-phenyl naphthyl amities. Antioxidant compounds may be used alone or in combination with other antioxidants. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol or 2,6-di-tert-butylphenol. Suitable examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof. Suitable alkylated diphenylamines include bis-nonylated diphenylamine, nonyl diphenylamine, octyl diphenylamine, bis-octylated diphenylamine, di-t-butylated diphenylamine, bis-decylated diphenylamine, decyl diphenylamine, bis-styrenated diphenylamine, styrenated diphenylamine, and mixtures thereof.

Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth)acrylic acid ester, a polyalkylstyrene, an hydrogenated alkenylaryl conjugated-diene copolymer, an ester of maleic anhydride-styrene copolymer or mixtures thereof. In some embodiments the viscosity modifier is a poly(meth)acrylic acid ester, an olefin copolymer or mixtures thereof.

Suitable foam inhibitors include polyacrylates, such as copolymers of ethyl acrylate and 2-ethylhexylacrylate, and optionally vinyl acetate; demulsifiers including polyglycol derivatives, trialkyl phosphates, polyethylene glycols, polyethylene oxides, polypropylene oxides, polyethers and (ethylene oxide-propylene oxide) polymers.

Suitable pour point depressants include esters of maleic anhydride-styrene, poly(meth)acrylates, polyacrylates or polyacrylamides; may also be used in the lubricant compositions of the invention.

Suitable demulsifiers include derivatives of propylene oxide, ethylene oxide, polyoxyalkylene alcohols, alkyl amines, amino alcohols, diamines or polyamines reacted sequentially with ethylene oxide or substituted ethylene oxides and mixtures thereof. Demulsifiers can be used alone or in combination. Examples of demulsifiers include but are not limited to trialkyl phosphates, polyethylene glycols, polyethylene oxides, polypropylene oxides, (ethylene oxide-propylene oxide)copolymers and mixtures thereof, in one embodiment the demulsifier is ethylene oxide-propylene oxide copolymer.

Suitable metal deactivators include derivatives of benzotriazoles, 1,2,4-triazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyl-dithio)-1,3,4-thiadiazoles, 2,5-bis(N,N-dialkyldithiocarbamoyl)-1,3,4-thiadiazoles, 2-alkyldithio-5-mercapto thiadiazoles or mixtures thereof. The metal deactivator may be used alone or in combination with other metal deactivators.

Examples of suitable a benzotriazole include those with hydrocarbyl group with substitutions on at least one ring position, such as, position 1- or 2- or 4- or 5- or 6- or 7- or mixtures thereof. The hydrocarbyl group includes 1 to about 30 carbon atoms, in one embodiment 1 to about 15 carbon atoms, in another embodiment 1 to about 7 carbon atoms. In one embodiment the benzotriazole is 5-methylbenzotriazole (tolyltriazole) or mixtures thereof. In one embodiment hydrocarbyl benzotriazole may be substituted at positions 4- or 5- or 6- or 7- and further reacted with an aldehyde and a secondary amine to form a Mannich product such as N,N-bis(heptyl)-ar-methyl-1H-benzotriazole-1-methanamine; N,N-bis(nonyl)-ar-methyl-1H-benzotriazole-1-methanamine.

When the metal deactivator is a 2,5-bis(alkyl-dithio)-1,3,4-thiadiazole or 2-monoalkyl-dithio-mercapto-1,3,4-thiadiazole the alkyl groups include 1 to about 30 carbon atoms, in one embodiment about 2 to about 25 carbon atoms, in another embodiment about 4 to about 20 and in yet another embodiment about 6 to about 16 carbon atoms. Examples of a suitable 2,5-bis(alkyl-dithio)-1,3,4-thiadiazole include 2,5-bis (alkyl-dithio)-1,3,4-thiadiazole, 2,5-bis(tert-nonyldithio)-1, 3,4-thiadiazole or mixtures thereof. Examples of a suitable 2-monoalkyl-dithio-mercapto-1,3,4-thiadiazole include 2-monononyl-dithio-mercapto-1,3,4-thiadiazole, 2-monododecyl-dithio-mercapto-1,3,4-thiadiazole or mixtures thereof.

The carboxylic acid or anhydride thereof may contain about 10 to about 400, or about 20 to about 200, or about 30 to about 150 carbon atoms.

The carboxylic acid or anhydride thereof may be derived from a polyolefin. The polyolefin may be a homopolymer, copolymer, or interpolymer. The polyolefin may be prepared from polymerisable monomers containing about 2 to about 16, or about 2 to about 8, or about 2 to about 6 carbon atoms. Often the polymerisable monomers comprise one or more of propylene, isobutene, 1-butene, isoprene, 1,3-butadiene, or mixtures thereof.

In one embodiment the carboxylic acid or anhydride thereof comprises a succinic acid or anhydride thereof.

In one embodiment the carboxylic acid or anhydride thereof comprises a polyisobutylene succinic acid or anhydride thereof. A more detailed description of a suitable carboxylic acid or anhydride thereof is described in WO 93/03121, page 33, line 10 to page 37, line 20.

The carboxylic acid or anhydride thereof may be present in ranges from 0 to about 3 wt %, or from about 0.0001 to about 3 wt %, or from about 0.001 to about 1 wt %, or from about 0.01 to about 0.5 wt % of the lubricating composition.

In one embodiment the invention provides a lubricating composition comprising an amine-functionalised additive of the present invention, an oil of lubricating viscosity and a thickener. The presence of the thickener typically results in the formation of a grease. In one embodiment the lubricating composition may be a grease.

The thickener may include simple metal soap thickeners, soap complexes, non-soap thickeners, metal salts of such acid-functionalized oils, polyurea and diurea thickeners, calcium sulphonate thickeners or mixtures thereof.

The thickener may for instance be a carboxylic acid, or mixtures thereof. The carboxylic acid may contain 2 to 30 carbon atoms. The carboxylic acid may be selected from a monocarboxylic acid, a polycarboxylic acid and mixtures thereof, and optionally the carboxylic acid is further substituted with groups selected from a hydroxyl group, an ester and mixtures thereof. In one embodiment the lubricating composition includes a carboxylic acid.

In one embodiment the carboxylic acid may also be used with other known thickening agents such as inorganic powders including clay, organo-clays, bentonite, famed silica, calcite, carbon black, pigments, copper phthalocyanine or mixtures thereof.

The carboxylic acid may be any combination of a mono- or poly-carboxylic; branched alicyclic, or linear, saturated or unsaturated, mono- or poly-hydroxy substituted or unsubstituted carboxylic acid, acid chloride or the ester of said carboxylic acid with an alcohol such as an alcohol of 1 to 5 carbon atoms. The carboxylic acid includes those with 2 to 30 carbon atoms, in another embodiment 4 to 30 carbon atoms, in another embodiment 8 to 27 carbon atoms, in another embodiment 12 to 24 carbon atoms and in yet another embodiment 16 to 20 carbon atoms. In one embodiment the carboxylic acid is a monocarboxylic acid or mixtures thereof. In one embodiment the carboxylic acid is a dicarboxylic acid or mixtures thereof. In one embodiment the carboxylic acid is an alkanoic acid. In one embodiment the carboxylic acid is a mixture of dicarboxylic acid and monocarboxylic acid typically in the weight percent ratio of 99:1, 70:30, 50:50, 40:60, 35:65, 30:70, 25:75, 20:80, 15:85, 10:90, 5:95 or 1:99. Dicarboxylic acid compounds tend to be more expensive than a monocarboxylic acid and as a consequence, most industrial processes using mixtures use a ratio of dicarboxylic acid to monocarboxylic acid in the range 30:70 or 25:75 to 20:80 or about 15:85.

In one embodiment the carboxylic acid is hydroxy substituted or an unsubstituted alkanoic acid. Typically, the carboxylic acids will have 2 to 30, in another embodiment 4 to 30, in another embodiment 12 to 24 and in yet another embodiment 16 to 20 carbon atoms. In one embodiment the carboxylic acid is a hydroxystearic acid or esters of these acids such as 9-hydroxy, 10-hydroxy or 12-hydroxy, stearic acid, and especially 12-hydroxy stearic acid. The monocarboxylic acid having this number of carbon atoms are generally associated with an HLB (hydrophile to lipophile balance) of 10 or more, in another embodiment 12 or more and in another embodiment 15 or more when converted to their salt form.

Other suitable saturated carboxylic acid compounds include capric acid, lauric acid, myristic acid, palmitic acid, arachidic acid, behenic acid, lignoceric acid or mixtures thereof.

Examples of suitable unsaturated carboxylic acid compounds include undecylenic acid, myristoleic acid, palmitoleic acid, oleic acid, gadoleic acid, elaidic acid, cis-eicosenoic acid, erucic acid, nervone acid, 2,4-hexadienoic acid, linoleic acid, 12-hydroxy tetradecanoic acid, 10-hydroxy tetradecanoic acid, 12-hydroxy hexadecanoic acid, 8-hydroxy hexadecanoic acid, 12-hydroxy icosanic acid, 16-hydroxy icosanic acid 11,14-eicosadienoic acid, linolenic acid, cis-8, 11,14-eicosatrienoic acid, arachidonic acid, cis-5,8,11,14, 17-eicosapentenoic acid, cis-4,7,10,13,16,19-docosahexenoic acid, all-trans-retinoic acid, ricinoleic acid lauroleic acid, eleostearic acid, licanic acid, citronelic acid, nervonic acid, abietic acid, and abscisic acid. Most preferred acids are palmitoleic acid, oleic acid, linoleic, acid, linolenic acid, licanic acid, eleostearic acid or mixtures thereof.

The polycarboxylic acid, especially dicarboxylic acids is present in a complex grease and suitable examples include iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid or mixtures thereof. In one embodiment the polycarboxylic acid is nonanedioic acid (azelaic acid) or mixtures thereof. In one embodiment the polycarboxylic acid is decanedioic acid (sebacic acid) or mixtures thereof.

A grease may include a sulphonate grease. Sulphonate greases are disclosed in more detail in U.S. Pat. No. 5,308,514 and U.S. patent application Ser. No. 10/806/591. The calcium sulphonate grease may be prepared from overbasing the calcium sulphonate such that the calcium is carbonated to form either calcite, or vaterite, typically calcite.

The amount of carboxylic acid present in the invention includes those in the range from 0 wt % to 30 wt %, in another embodiment 0.1 wt % to 25 wt %, in another embodiment 0.5 wt % to 20 wt %, in another embodiment 1 wt % to 17 wt %, and in yet another embodiment 3 wt % to 13 wt % of the grease composition.

When the lubricating composition of the invention contains the carboxylic acid (i.e. forms a grease), the composition optionally further includes at least one other performance additive. The other performance additive compounds include a metal deactivator, a detergent, a dispersant, an antiwear agent, an antioxidant, a corrosion inhibitor, a foam inhibitor, a demulsifiers, a pour point depressant, a seal swelling agent or mixtures thereof.

The total combined amount of the other performance additive compounds present on an oil free basis in ranges from 0 wt % or even 0.001 wt % to 25 wt %, in another embodiment 0.01 wt % to 20 wt %, in another embodiment 0.04 wt % to 15 wt % and in yet another embodiment 0.06 wt % to 10 wt of the composition. Although one or more of the other performance additives may be present, it is common for the other performance additives to be present in different amounts relative to each other.

In preparing the grease composition, the amine-functionalised additive may be mixed with an oil of lubricating viscosity under grease-forming conditions of heating and mixing known in the art. In another embodiment, the amine-functionalised additive can be mixed with a pre-formed grease composition. These processes may also include the addition of a grease thickening agent with the amine-functionalised additive reaction product.

INDUSTRIAL APPLICATION

In some embodiments the additive of the invention may be added to a lubricant in a range of 0.01 wt % to 20 wt %, or 0.05 wt % to 10 wt %, or 0.08 wt % to 5 wt %, or 0.1 wt % to 3 wt % of the lubricating composition. In other embodiments the additive is present at any one of the ranges discussed in the sections above.

The method of the invention is useful for lubricating a variety of mechanical devices. The mechanical device comprises at least one of an internal combustion engine (for crankcase lubrication), a hydraulic system, an axle, a gear, a gearbox or a transmission. In one embodiment the mechanical devices includes a driveline device such as an axle, a gear, a gearbox or a transmission.

The lubricating oil composition is used in industrial fluids, hydraulic fluids, turbine oils and circulating oils.

The lubricating composition may be utilized in a turbine engine including combustion turbine engines, steam turbines, rotary combustion engines, avionic turbine engines, and turbocharged engines.

In one embodiment, the turbine engine is a jet engine, a gas turbine engine, a steam turbine engine, an industrial gas turbine engine, a turboshaft engine, a radial gas turbine engine, and a combined cycle gas turbine engine.

A transmission includes a manual transmission, an automatic transmission, continuously variable transmissions (CVT), infinitely variable transmissions (IVT), toroidal transmissions, continuously slipping torque converter clutches (CSTCC), stepped automatic transmissions or dual clutch transmissions (DCT).

The gear oil or axle oil may be used in planetary hub reduction axles, mechanical steering and transfer gear boxes in utility vehicles, synchromesh gear boxes, non-synchromesh gearboxes, power take-off gears, limited slip axles, torque vectoring devices and planetary hub reduction gear boxes.

The manual transmission may be unsynchronized, or may contain a synchronizer mechanism. The gearbox may be self-contained, or may additionally contain any of a transfer gearbox, planetary gear system, differential, limited slip differential or torque vectoring device, which may be lubricated by the manual transmission fluid.

In one embodiment of the invention the lubricating oil composition may be used in turbine oils. The use of the lubricating oil composition prevents the formation of filter plugging deposits and sludge in turbines. The invention further provides a lubricating oil composition used in a turbine, wherein the lubricating oil composition comprises an amine-functionalised additive, an oil of lubricating viscosity and optionally other additives.

Optionally the turbine oil composition includes but is not limited to an additive selected from the group of a foam inhibitor, a demulsifier, a viscosity modifier, pour point depressants or mixtures thereof. The optional additives may be present in the range from 0 to 13, or 0.00075 to 5, or 0.001 to 0.4, or 0.0015 to 0.2 wt % of the lubricating oil composition, or within any of the ranges described above. The optional additives may be used alone or mixtures thereof.

In one embodiment, the composition of the present invention is useful in a hydraulic fluid. In one embodiment the hydraulic fluid is suitable for hydraulic launch assist apparatus. In one embodiment the hydraulic fluid is for a hydrostatic transmission.

The use of the composition of the invention imparts one or more performance characteristics including improved cleanliness, and oxidative resistance As a hydraulic fluid, the composition of the invention optionally further includes at least one other performance additive. The other performance additive compounds include a metal deactivator, a detergent, an antioxidant, a corrosion inhibitor (other than the ashless rust inhibitor), an antiscuffing agent, a foam inhibitor, a demulsifier, a pour point depressant, a seal swelling, agent or mixtures thereof. In one embodiment the composition further includes at least one compound including the group consisting of a metal deactivator, a detergent and an antioxidant. In one embodiment the composition further includes at least two compounds including a metal deactivator, a detergent or an antioxidant. In one embodiment the composition further includes a metal deactivator, a detergent and an antioxidant.

The invention is useful for lubricating a gear(s) or bearing(s). In one embodiment the lubricant is a gear oil or bearing oil.

In one embodiment the invention is capable of providing a lubricants and a method of lubricating a gear and/or a bearing; and capable of providing at least oxidation stability and cleanliness.

The following examples provide illustrations of the invention. These examples are non-exhaustive and are not intended to limit the scope of the invention.

EXAMPLES

Preparative Example 1 (EX1) is a complex aromatic amine synthesis. 500 ml of 2M hydrochloric acid is added to a one-liter 4-neck flask equipped with an overhead stirrer, thermowell, addition funnel with nitrogen line, and condenser. 184.2 g of 4-arninodiphenylamine is added, and the flask is heated to 75° C. The addition funnel is then charged with 40.5 g of a 37% formaldehyde solution and the solution is added drop-wise to the flask over a period of 30 minutes. The flask is maintained at 100° C. for 4 hours. The flask is then cooled to ambient temperature, 80 g of a 50/50 wt/wt solution of sodium hydroxide in water is added over 30 minutes. At the end of the reaction, a solid product is obtained via filtration. The resultant solid product is believed to primarily be the compound of Formula (2) as described above. In addition, the resultant product may contain a small percentage of product based on Formula (3) as described above.

Preparative Example 2 (EX2) is a reaction product of polyisobutylene succinic anhydride with product prepared according to the procedures of EX 1. A three-liter, 4-neck flask equipped with an overhead stirrer, thermowell, subsurface inlet with nitrogen line, and Dean-Stark trap with condenser is charged with polyisobutylene succinic anhydride (1270.0 g) (where the polyisobutylene has a number average molecular weight of 2000) and diluent oil (1400.1 g). The flask is heated to 90° C. The product of EX1 (442.0 g) is added slowly. The temperature is then raised to 110° C. and held until the water from the product of EX1 is removed. The temperature is then raised to 160° C. and held for 10 hours. To the flask is added a portion of a diatomaceous earth filter aid, and then flask contents are filtered through a second portion of the diatomaceous earth filter aid. The resultant product is a dark oil with a nitrogen content of 0.65 wt %.

Preparative Example 3 (EX3) is a reaction product of a maleinated ethylene-propylene copolymer with product prepared according to the procedures of EX1. A two-liter, 4-neck flask equipped with an overhead stirrer, thermowell, subsurface inlet with nitrogen line, and Dean-Stark trap with condenser is charged with a maleinated ethylene-propylene copolymer (where the ethylene-propylene copolymer has a number average molecular weight of 8000, and 3.3 wt % of maleic anhydride is grafted on to the ethylene-propylene copolymer) diluted in oil (75:25 wt %) (350.0 g) and diluent oil (906.8 g). The flask is heated to 110° C. The product of EX1 (19.8 g) is added slowly. The temperature is then raised to 160° C. and held for 6 hours. To the flask is added a portion of a diatomaceous earth filter aid, and then flask contents are filtered through a second portion of the diatomaceous earth filter aid. The resultant product is a dark oil with a nitrogen content of 0.17 wt %.

Preparative Example 4 (EX4) is a reaction product of methylenedianiline and nitrobenzene. A 500-ml three-necked round bottom flask with an overhead stirrer is charged with methylenedianiline (213 g, 1.08 mol) and heated to 100° C. Nitrobenzene (4.3 ml, 42 mmol) is then charged to the flask. To the stirred reaction mixture is added tetramethylammonium hydroxide dihydrate (17.7 g, 140 mmol) as a solid. The reaction is allowed to stir for 18 hours. Water (16 ml) is added to the mixture and the reaction is charged to an autoclave for hydrogenation. A 1% Pt/C catalyst (0.5 g dry weight) is added and the mixture heated to 100° C. under 1.034 MPa (equivalent to 150 psig) of hydrogen for 30 minutes.

Preparative Example 5 (EX5) is a reaction product of methylenedianiline and nitrobenzene. A 25 ml round bottom flask is charged with dimethyl sulphoxide (DMSO) (4 ml), methylenedianiline (208 mg, 1.05 mmol), nitrobenzene (200 ml, 1.9 mmmol) and tetramethylammonium hydroxide dihydrate (330 mg, 2.5 mmol) under argon. The reaction is allowed to proceed at room temperature for 4 hours. The reaction is charged to an autoclave for hydrogenation. A 1% Pt/C catalyst (0.5 g dry weight) is added and the mixture heated to 100° C. under 1.034 MPa (equivalent to 150 psig) of hydrogen for 30 minutes, Inventive Turbine Oils 1 to 7 (ITO1 to ITO7) are prepared by adding a commercially available turbine oil additive concentrate package into a Group II base oil and/or Group III base oil. The commercially available turbine oil additive concentrate package is

TABLE 1

Composition of commercial Turbine Oil Concentrate

| Component | wt % of each additive in the concentrate |
|---|---|
| Amine Salt of Phosphate ester | 8.33 |
| Dialkyldiphenyl amine | 62.5 |

TABLE 1-continued

Composition of commercial Turbine Oil Concentrate

| Component | wt % of each additive in the concentrate |
|---|---|
| Hydrocarbyl sulphide | 15 |
| Acrylate polymer | 3.33 |
| Triazole | 0.33 |
| Polyether | 0.67 |
| Diluent oil | 9.84 |

The concentrate is then treated at between 0.1 and 0.75 wt % of the product of EX2 as shown in Table 2. The concentrate is then treated at 0.6 wt % into the Group ii base oil and/or a Group III base oil to form a turbine oil.

RBOT (Rotary Bomb Oxidation Test). The RBOT test is carried out according to ASTM D2272. The RBOT measures oxidation life of oils. Samples are reacted with oxygen ($O_2$), water, and a copper catalyst coil at 150° C. in a rotating bomb unit. The results report time in minutes for bomb pressure to drop 25 psi from the maximum pressure. Typically better results are obtained for oils having more time (in minutes) before the 25 psi pressure drop from the maximum pressure. The results obtained are summarized in the table below.

TABLE 2

ASTM D2272 Results

| Sample | EX2 wt % | D2272 results (minutes) Group II | D2272 results (minutes) Group III |
|---|---|---|---|
| Baseline[1] | 0 | 718 | 477 |
| ITO1 | 0.1 | 763 | N.M.[2] |
| ITO2 | 0.25 | 982 | N.M.[2] |
| ITO3 | 0.5 | 1080 | N.M.[2] |
| ITO4 | 0.75 | 1025 | N.M.[2] |
| ITO5 | 0.1 | N.M.[2] | 859 |
| ITO6 | 0.25 | N.M.[2] | 906 |
| ITO7 | 0.5 | N.M.[2] | 805 |

[1]The Baseline samples are identical to the inventive examples except that the baseline samples do not contain the product of EX2. That is the Group II baseline sample is identical to the Group II IT01 sample, except that the Group II baseline sample does not contain any amount of the EX2 material, and so on.
[2]N.M. indicates a composition not tested in the listed group oil.

The results of the Rotary bomb Oxidation test indicate that a lubricating composition of the present invention improves the oxidative stability of the turbine oil resulting in extended life of hardware and decreased downtime.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." it is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity, 0.05 wt % to 5 wt % of an alkylated diarylamine and 0.1 wt % to 2 wt % of an amine functionalised additive derived from an amine having at least 3 aromatic groups, at least one —$NH_2$ functional group, and at least 2 secondary or tertiary amino groups where the —$NH_2$ group is condensed with (i) a hydrocarbyl-substituted phenol and an aldehyde in a Mannich reaction to make a covalent attachment of the amine to the hydrocarbyl-substituted phenol or (ii) a carboxylic functionalized polymer, and wherein the amine-functionalised additive is a product obtained by reacting the amine having at least 3 aromatic groups, at least one —$NH_2$ functional group, and at least 2 secondary or tertiary amino groups with a carboxylic functionalised polymer.

2. The lubricating composition of claim 1, wherein the amine-functionalised additive is derived from an amine having at least 4 aromatic groups, at least one —$NH_2$ functional group, and at least 2 secondary or tertiary amino groups.

3. The lubricating composition of claim 1, wherein the amine having at least 3 aromatic groups, at least one —$NH_2$ functional group, and at least 2 secondary or tertiary amino groups is represented by the formula:

Formula (1)

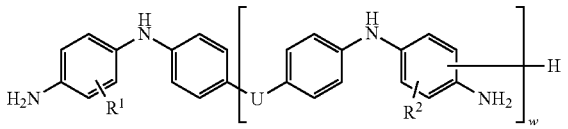

wherein independently each variable, $R^1$ is hydrogen or a $C_{1-5}$ alkyl group;

$R^2$ is hydrogen or a $C_{1-5}$ alkyl group;

U is an aliphatic, alicyclic or aromatic group, with the proviso that when U is aliphatic, the aliphatic group may be linear or branched alkylene group containing 1 to 5 carbon atoms; and w is 1 to 4.

4. The lubricating composition of claim 1, wherein the amine having at least 3 aromatic groups is bis[p-(p-aminoanilino)phenyl]-methane, 2-(7-amino-acridin-3-ylmethyl)-N-4-{4-[4-(4-amino-phenylamino)-benzyl]-phenyl}-benzene-1,4-diamine, or mixtures thereof.

5. The lubricating composition of claim 1, wherein the carboxylic functionalised polymer is a polyisobutylene-succinic anhydride polymer, a maleic anhydride-styrene copolymer, an ester of a maleic anhydride-styrene copolymer, an alpha olefin-maleic anhydride copolymer, or a maleic anhydride graft copolymer of (i) a styrene-ethylene-alpha olefin polymer, (ii) a hydrogenated alkenyl aryl conjugated diene copolymer, (iii) a polyolefin, or (iv) a hydrogenated isoprene polymer, or mixtures thereof.

6. The lubricating composition of claim 5, wherein the carboxylic functionalised polymer is a polyisobutylene succinic anhydride, wherein the polyisobutylene succinic anhydride is derived from a polyisobutylene with a number average molecular weight of 750 to 2500.

7. The lubricating composition of claim 5, wherein the hydrogenated alkenyl aryl conjugated diene copolymer is a hydrogenated copolymer of styrene-butadiene.

8. The lubricating composition of claim 5, wherein the polyolefin grafted with maleic anhydride is an ethylene-propylene copolymer.

9. The lubricating composition of claim 5, wherein the hydrogenated isoprene polymer is a hydrogenated styrene-isoprene polymer.

10. The lubricating composition of claim 1, wherein the amine-functionalised additive is present at 0.1 wt % to 0.5 wt % of the lubricating composition, and the alkylated diarylamine is present at 0.1 wt % to 0.5 wt % of the lubricating composition.

11. A method of lubricating a mechanical devices, comprising at least one of, a hydraulic system, an axle, a gear, a gearbox or a transmission comprising supplying to the mechanical device the lubricating composition of claim 1.

12. The method of claim 10, wherein the mechanical device is a hydraulic system.

* * * * *